US006698953B1

(12) United States Patent
Hertlein

(10) Patent No.: US 6,698,953 B1
(45) Date of Patent: Mar. 2, 2004

(54) PRINT IMAGE WITH PRINT ELEMENTS HAVING DIFFERENT SECURITY LEVELS ASSIGNED THERETO, AND AN APPARATUS AND STORAGE MEDIUM FOR PRODUCING SUCH A PRINT IMAGE

(75) Inventor: Jens Hertlein, Wildau (DE)

(73) Assignee: Francotyp-Postalia AG & Co. KG, Birkenwerder (DE)

( * ) Notice: Subject to any disclaimer, the term of this patent is extended or adjusted under 35 U.S.C. 154(b) by 353 days.

(21) Appl. No.: 09/610,058

(22) Filed: Jul. 5, 2000

(30) Foreign Application Priority Data

Jul. 5, 1999 (DE) ..... 199 30 723
Jul. 12, 1999 (DE) ..... 199 31 962

(51) Int. Cl.[7] ..... B41J 5/00
(52) U.S. Cl. ..... 400/103; 400/104
(58) Field of Search ..... 400/103, 104

(56) References Cited

U.S. PATENT DOCUMENTS 4,802,218 A * 1/1989 Wright et al. ..... 705/60
4,812,994 A 3/1989 Taylor et al.
4,837,714 A * 6/1989 Brookner et al. ..... 702/108
5,590,198 A * 12/1996 Lee et al. ..... 380/21
5,707,158 A 1/1998 Hansel et al.
5,742,683 A * 4/1998 Lee et al. ..... 380/23
5,805,711 A * 9/1998 Windel et al. ..... 380/55
6,111,951 A * 8/2000 Guenther ..... 235/375
6,260,028 B1 * 7/2001 Lee et al. ..... 705/401

FOREIGN PATENT DOCUMENTS

| | | |
|---|---|---|
| DE | OS 43 02 097 | 7/1994 |
| DE | OS 197 57 652 | 6/1999 |
| EP | 0 762 334 | 3/1997 |
| EP | 0 782 110 | 7/1997 |
| EP | 0 789 333 | 8/1997 |
| EP | 0 908 853 | 4/1999 |
| GB | 2 074 942 | 11/1981 |

* cited by examiner

*Primary Examiner*—Charles H. Nolan, Jr.
(74) *Attorney, Agent, or Firm*—Schiff Hardin & Waite

(57) ABSTRACT

A print image, such as for a franking apparatus, is composed of a number of elements to which different security levels are assigned. In a storage medium, and in a franking apparatus containing such a storage medium, for the print image, the image data are stored in a manner allocated to respectively different security levels.

3 Claims, 8 Drawing Sheets

| Security level a or b | Authori-zation by Card type | Definition | Relevant image seg-ments (only examples) | Remarks |
|---|---|---|---|---|
| 0 | None | Can be changed at any time by everybody | None | Currently no example |
| 1 | User Card | Segment in the print image data that can be updated by a normal user, master or dealer technician, using the chip card for authorization | None | Meter ad which is on the user card is able to load into the temporary advertisement memory (FIFO, see section 3.5.3.1). This meter ad can't load to the print image data. |
| 2 | Master Card | Segment in the print image data that can be updated by a master or dealer technician, using the chip card for authorization | Advertisement (a)<br>Town circle (a)' | The master of the JetMail is able to load meter ads and town circle from a chip card [F1][JH2], which is generated at a clichè workstation by FP, to the print image data memory. |
| 3 | Dealer Card | Segment in the print image data that can be updated by a dealer technician, using the dealer card for authorization | Endorsement (a)<br>Town circle (b) | The dealer technician is able to load fonts and text of endorsement from a chip card, which is generated at a clichè workstation by FP, to the print image data memory. He can also change manually the text information of the town circle, not the fonts. |
| 4 | FP Card | Segment in the print image data that can be updated by a FP technician, using the FP Card | Month, Date, Century, Year (a) | The FP technician will be able to load fonts for the date from a chip card, which is generated at a clichè workstation by FP, to the print image data memory. |
| 5 | FP R&D | Segment in the print image data that can't be updated separately. Only the function "First-time initialization of the print image data" can change these segments. | All other segments (a) and (b) | These segments can only updated, if all print image data will updated. These function need the FP Card or is prohibited (see section 4.1) |

Fig. 2

Fig. 7 Changing print image data using chip cards

PRINT IMAGE WITH PRINT ELEMENTS HAVING DIFFERENT SECURITY LEVELS ASSIGNED THERETO, AND AN APPARATUS AND STORAGE MEDIUM FOR PRODUCING SUCH A PRINT IMAGE

BACKGROUND OF THE INVENTION

1. Field of the Invention

The present invention is directed to a print image of the type wherein security information or security protection is incorporated in the print elements of the print image, as well as to an apparatus and a storage medium for producing such a print image.

2. Description of the Prior Art

It is known to print a print image composed of a number of elements or parts onto a piece of mail with a postage meter machine. Such a print image is regularly composed, for example, of a postage stamp image, a date stamp image and an advertising image, as shown in FIG. 8.

A method for generating a print image that a postage meter machine prints on a carrier (piece of mail) is disclosed, for example, by European Application 0 762 334 or European Application 0 789 333. It is known from these publications that, for printing a print image that is composed of a number of sub-images, a microprocessor of the postage meter machine accesses a number of picture element datafiles, with the picture elements that define an image element or a text element (sub-image) of the print image being combined in each picture element datafile. Each picture element datafile, moreover, has an identification code allocated to it under which the appertaining sub-image (image element or text element) can be located. The microprocessor also accesses a control datafile that contains a number of sub-image datafiles that respectively contain sub-image data that define a sub-image of the print image. The microprocessor processes the sub-image datafiles of the print image to be printed and, when processing the sub-image datafiles, employs the sub-image data for generating the print image from the picture element data of at least one picture element datafile identified by the respective reference code.

It is desirable in known postage meter machines to permit specific functions of the postage meter machine to be implemented only after authorization with a card or input of a password. Further, there are security rules that forbid certain parts of the print image from being individually freely designed, for example the postage value and/or the date stamp. The spatial position of the date and/or postage stamp on a piece of mail is also fixed and should not be individually varied.

The problem also arises in the manufacture of postage meter machines and their setting that different rules about the print image layout must be taken into consideration dependent on where they are used. Thus, for example, the postal rules in the USA are different from Germany. It is in fact possible to program a postage meter machine with specific defaults and data at the manufacturer, based on security-dependent considerations, however, this should only ensue centrally at the manufacturer but not at subsequent dealer locations. Such a central data input is contrary to the individual adaptation of the postage meter machine to various customers in different countries. Thus, every customer will want to print its own advertizing message, although it must likewise be prevented that an advertising imprint has the form of a postmark, so that the advertising imprint by itself is not mistaken for a postmark. For this reason and because it is also important to prevent obscenities (pornography) from being present in the postmark field, it is desirable that the operator of the postage meter machine can undertake possible changes to only a limited extent, so that the regulations and security rules that exist in a country can be adhered to.

It is also known to input print image data or print sub-image data into the postage meter machine with a chip card. The data from the chip cards are transferred into a memory of the postage meter machine, so that the microprocessor can compile the sub-image data required for printing.

Since which user will use the postage meter machine in which way can usually not be predicted upon manufacture of:the postage meter machine and information about the user of the postage meter machine only exist in the final distribution stages, it is desirable in view of the existing problem of adhering to regulations and security levels that the individual setting of a postage meter machine can be undertaken on site, i.e. in the country of the postage meter machine user or at the user's premises, so that the individual design can be implemented fast and economically, even, in certain circumstances, in conjunction with the advertizing agency of the postage meter machine distributor.

The disadvantage of known chip card systems is that, given adaptation of the postage meter machine at the manufacturer, only slight flexibility is possible or, when the setting of the print image data is undertaken during the final stages of distribution or by the contractual dealer, there is the risk of misuse and incorrect setting of the most important print image data. Very thorough training and technical schooling for the data input is then also required on the part of the distributor or dealer, which is already impractical for cost reasons.

SUMMARY OF THE INVENTION

An object of the present invention is to avoid these disadvantages so that an image, particularly a print image, can be generated that assures a high level of security and great flexibility for individual adaptation.

The object is achieved in accordance with the invention in an image, particularly the print image to be printed by the postage meter machine, which is composed of a number of elements with different security levels are assigned to the elements. The deletion or modification of image elements is only possible when the security levels respectively required for the image elements are met or documentation thereof is produced in the input/modification of new image data.

If the presence (authorization) of the required security level is not documented in the sub-image input/sub-image modification, the desired, new input or modification cannot ensue.

When, for example, an image element to which a specific security level, for example security level 4, is assigned is to be replaced by another picture element, then this should only be possible when the security level 4 (or higher) can be entered or documented in the operation of the postage meter machine, for example with a chip card.

A hierarchic structure of security levels makes it possible, first, to provide the needed flexibility in the setting of the postage meter machine and, second, to preclude the possibility of undesired manipulations. A system wherein (sensitive) image elements can only be deleted, input anew or modified when proof of meeting the correspondingly allocated security level is produced, also makes sit possible for picture elements having a lower security level, for example advertizing texts, to be entered, modified or enabled only shortly before the commissioning of the postage meter machine.

DESCRIPTION OF THE DRAWINGS

FIG. 2 is a table with the allocation of security levels for specific authorizations in accordance with the invention.

DESCRIPTION OF THE PREFERRED EMBODIMENTS

Figure 1:
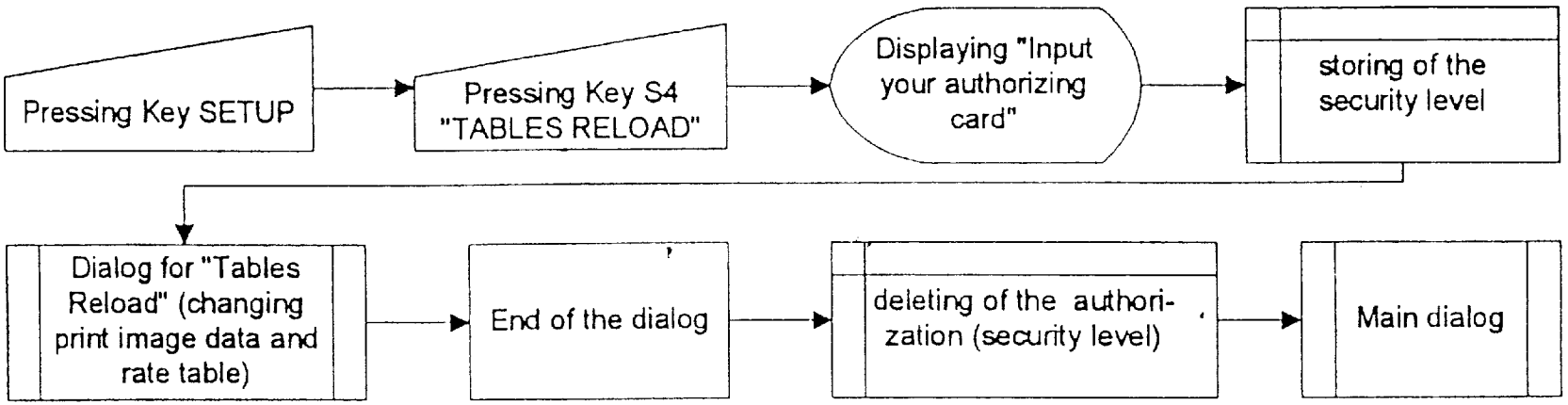
FIG. 1 is a flowchart for an authorization procedure for producing an inventive image.

FIG. 1 shows the flowchart for an authorization procedure. It is assumed that the user of a postage meter machine inserts a chip card into a corresponding chip card reader of the postage meter machine in order to load, modify or delete an image or element of an image in a memory of the postage meter machine.

After pressing the key "SETUP" or after pressing the key S4 "TABLES RELOAD", the display "Insert your authorizing card" appears at a display of the postage meter machine. After insertion of the authorization card, for example a user card, the security level stored on the card is stored in a memory of the postage meter machine. A dialogue between the postage meter machine and the chip card subsequently begins, in which the entire print image or only elements of the print image are replaced when adequate authorization is established. After the end of the dialogue, the authorization is revoked and a return into the main program ensues.

An example wherein five authorization levels are provided for the postage meter machine is described below. As already set forth, an authorization is implemented by inserting a chip card into the postage meter machine. In a Table, FIG. 2 shows the allocation of the various security levels, :starting from 0 (lowest security level) through 4 (highest security level) to certain groups of persons or to different operating personnel.

Security level 0 requires no authorization and is a chip card that can be employed by any user of the postage meter machine.

Security level 1 is assigned to a user card (chip card) and is intended for the normal user of the postage meter machine.

Security level 2 is the security level of a "master card" that is envisioned for the supervisory personnel of the postage meter machine.

Security level 3 stands for a "dealer card" and is reserved for the dealer and the technical personnel of the postage meter machine dealer.

Security level 4 authorizes the manufacturer and is only assigned to persons of the manufacturer or to the manufacturer's technical staff. Whereas security levels 3 and 4 are intended only for staff of the manufacturer or of the manufacturer's distributors, security levels 0, 1 and 2 are intended for persons who wish to use the postage meter machine.

The main purpose of the various security levels is to assure during operation of the postage meter machine that print image data of the postage meter machine that are stored in the memory of the postage meter machine can only be entered, deleted and/or modified in a very specific fashion and only by persons authorized to do so.

Figure 3:
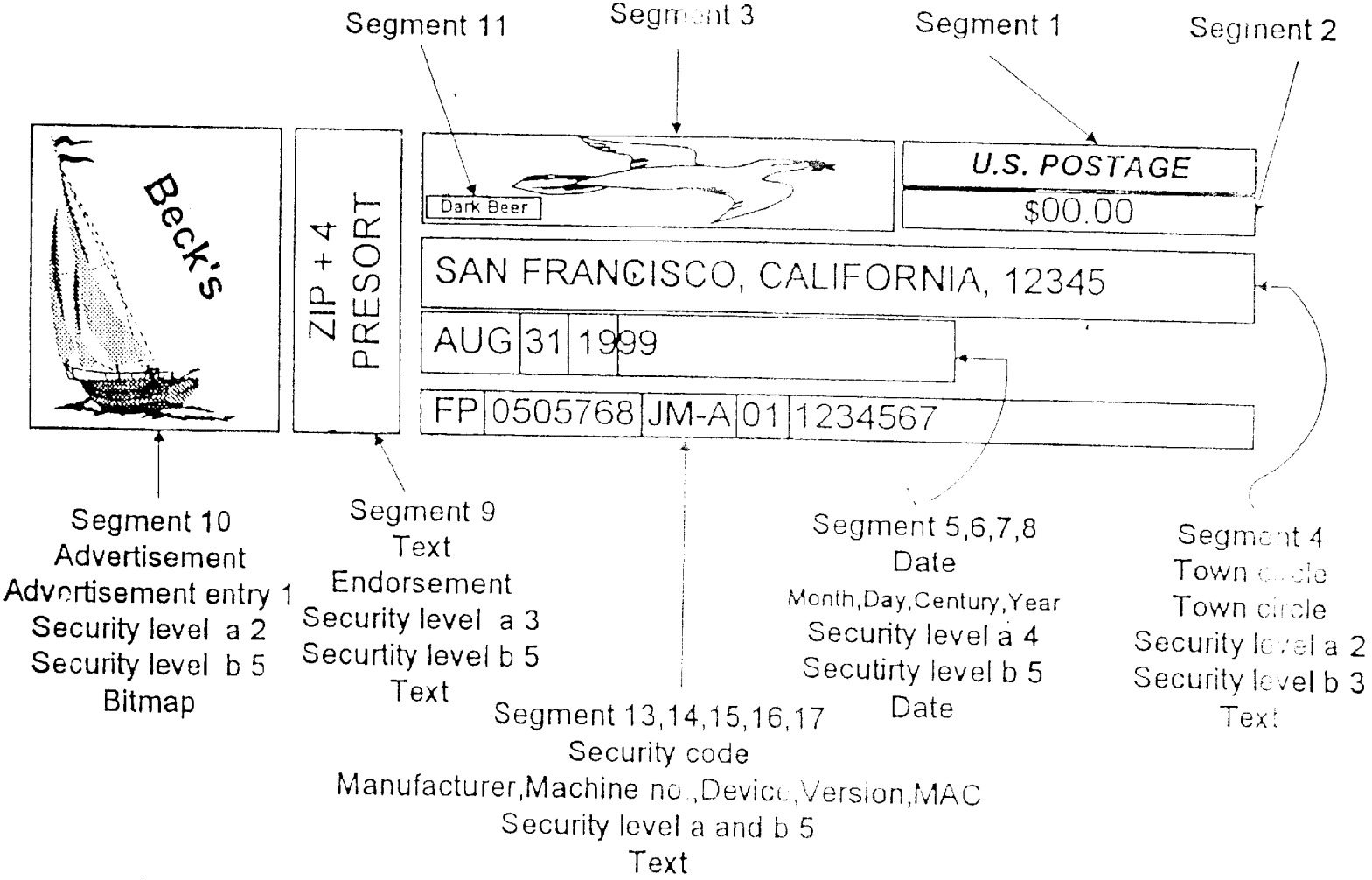
FIG. 3 illustrates of an inventive image composed of a number of segments that exhibit different security levels.

It is assumed that the overall image or print image—shown in FIG. 3—that can be generated by the postage meter machine is composed of various elements, parts or segments, whereby an element, part or segment of an image can represent text, graphics or mixed text/graphics. Each print image element (segment) optionally has two security levels in its data structure: a security level (a) that is a necessary level for loading from the chip card and the security level (b) that is a necessary level for the (manual) modification of a print image element.

Before the loading of an image element from the chip card, the postage meter machine or the franking device checks whether the authorization of the chip card is a higher level or the same level as security level (a) of the print image element. Security level 5 means that no one can separately modify data composed of data having such a security level.

Before modification or the change of image elements is allowed, the postage meter machine checks whether the authorization of the user or of the card inserted by the user is higher than or the same as security level (b) of the print image element. Security level 5 also denotes that no one can modify or replace these segment data or this segment.

In this way, it is possible that an operator with a master card (security level 2) could modify the date and locality stamp image—see FIG. 3—with a chip card, and an operator with a dealer card could also manually modify the date/locality stamp image.

The security levels of print image elements can be described as follows.

Security level 0 is not authorized by a special card and the data given image element segments having the security level 0 (a or b) can be modified at any time by anyone.

The authorization for security level 1 (a or b) ensues with a user card with which elements in the print image data can be updated by a normal user or by the trained personnel of the postage meter machine (master) or by a dealer or the dealer's technical staff, who use the chip card for the authorization.

The authorization for security level 2 ensues with a master card with which elements of the print images can be loaded or updated by the trained service personnel for the postage meter machine, by the dealer or the dealer's technical staff using the master card. For example, advertizing texts (security level a) or the date/locality stamp (security level a) can be loaded/modified with this. The postage meter machine is thereby loaded with the data for an advertizing message and the date/locality stamp from a chip card on the basis of the master card. This chip card is produced by a slogan-making (cliché) workstation and this slogan-making workstation is operated by the postage meter machine manufacturer or an authorized dealer.

The authorization for security level 3 ensues with the dealer card. The updating of print image element data by the technical staff of the dealer is therewith possible upon employment of the dealer card. With the dealer card, it is possible to enter or modify print image data for the endorsement (security level a) as well as for the date/locality stamp (security level b). With the dealer card, the dealer's technical staff can load fonts and endorsement text from a chip card into the postage meter machine, whereby these data are produced by slogan-making workstation of the manufacturer or of an authorized dealer. These data are loaded into a print image date store of the postage meter machine. With the dealer card, the dealer's technical staff is also able to manually modify text information of the date/locality stamp image (but not their fonts), for which reason the security level (b) is provided for the date/locality stamp.

Security level 4 is authorized by the manufacturer card (FP card, in the case of the present assignee Francotyp-Postalia AG & Co.) with which print image elements can be modified/set by the manufacturer's technical staff upon employment of the manufacturer card. For example, date particulars (month, year, day, century, date, etc.) of the date stamp image can be loaded therewith. With the manufacturer card, the manufacturer's technical staff is able to load fonts for the date of the date stamp image from a chip card (second chip card). This chip card is generated by a slogan-making workstation of the manufacturer, and the data are read into a print image data store when loaded.

Security level 5 is authorized by the R+D (research and development) card of the manufacturer. The loading and the modifying of print image elements having the highest security level is possible with this card. When image elements are read in with the card having security level 5, this is only possible when all (other) print image elements are read in anew.

As already set forth, the reason for the various security levels is to be able to allocate a security level to an image element in the print image data memory of the postage meter machine, or a memory connected thereto. In this way, it is also possible to modify the security level with a function such as first-time initialization of the print image data. It is possible to provide different security structures for each country without thereby having to modify the entire program execution.

The various functions of the individual chip cards are explained in greater detail below. As already described, there are cards with the stored security level and cards that also contain print image data. When certain print image data are to be read into the postage meter machine or are to be modified or deleted, this can ensue only with employment of the respective authorization cards (user card, master card, etc.). The insertion of a print image card into a corresponding chip card reader of the postage meter machine is thus not adequate; rather, the insertion of the corresponding authorization card is also required.

The cards (storage media) that contain the print image data are usually of the type AT42C256 and contain an EEPROM having a capacity of 32 kBytes. These cards do not have a processor; however, a specific code number is stored in them, as is the (physical) chip card type as well. The print image chip card can be machine-independent, i.e. a machine number (of the postage meter machine) is not stored in it. When, however, a machine number is stored, then it can be deleted by the machine having this machine number. Data for the first and last validity are stored in the card, and, when a number of chip cards are needed for the input of a print image, a corresponding number is assigned to each chip card for this purpose. A number of image elements with a corresponding MAC (message authentification code) can be stored with a print image data card and read into a postage meter machine. The print image data are stored on the card together with security level data. Whether the print image segments to be loaded should be deleted from the chip card after a successful loading event is also stored on the chip card. This allows specific print image segments to be loaded only once into the machine.

The user card is usually of the type AT 24C256 (manufacturer: ATMEL) and likewise comprises an EEPROM with a capacity of 32 kBytes. This card does not have a processor; a specific code number as well as the chip card type or the chip category are stored in it at the manufacturer. The machine number of the postage meter machine to be operated and a corresponding user identification (user number) are also stored in the user card. The card likewise comprises data for the first and the last authorization, and, over and above this, the card contains its own card number, which identifies it. With the user card, it is also possible to store a specific number (for example, a maximum of three) image elements with a corresponding MAC and load them into the postage meter machine.

The master card is of the type SLE 4442 (manufacturer: Siemens) and has an EEPROM with a capacity of 256 bytes. A specific area (for example, 32 bytes) is thereby protected, and the master card comprises a PIN of, for example, 3 bytes. The card is likewise not equipped with a processor. The specific code number of the manufacturer side, the chip card type as well as the chip card category are stored in a protected area of the chip card. The same is true of the machine number of the postage meter machine to be operated and is also true of the user number. The data for the first and the last authorization of the card as well as a corresponding card number for the identification of the card are also stored.

The dealer card and the manufacturer card each have a structure similar to the master card, but differ in that the machine numbers of the postage meter machine to be programmed are not stored in them. The dealer card and the manufacturer card (FP card) are machine-independent.

The manufacturer card and the dealer card can be generated by the manufacturer. The master card can be produced using the dealer card and the user card can be produced using the master card. Thus the card having the next highest authorization can be employed, and in fact is necessary, for generating an authorization card.

The print image data can be stored on the storage card in a compressed or in a non-compressed data format. When the print image data are stored compressed, the memory space on the print image data card or user card can be utilized better. Given a small scope of the dataset of an image element, however, it is also advantageous to store the data on the chip card non-compressed and to read the data directly therefrom into the memory of the postage meter machine, this having the advantage that both the programming of the chip card as well as the read-in of the memory is as fast as possible.

Figure 4:
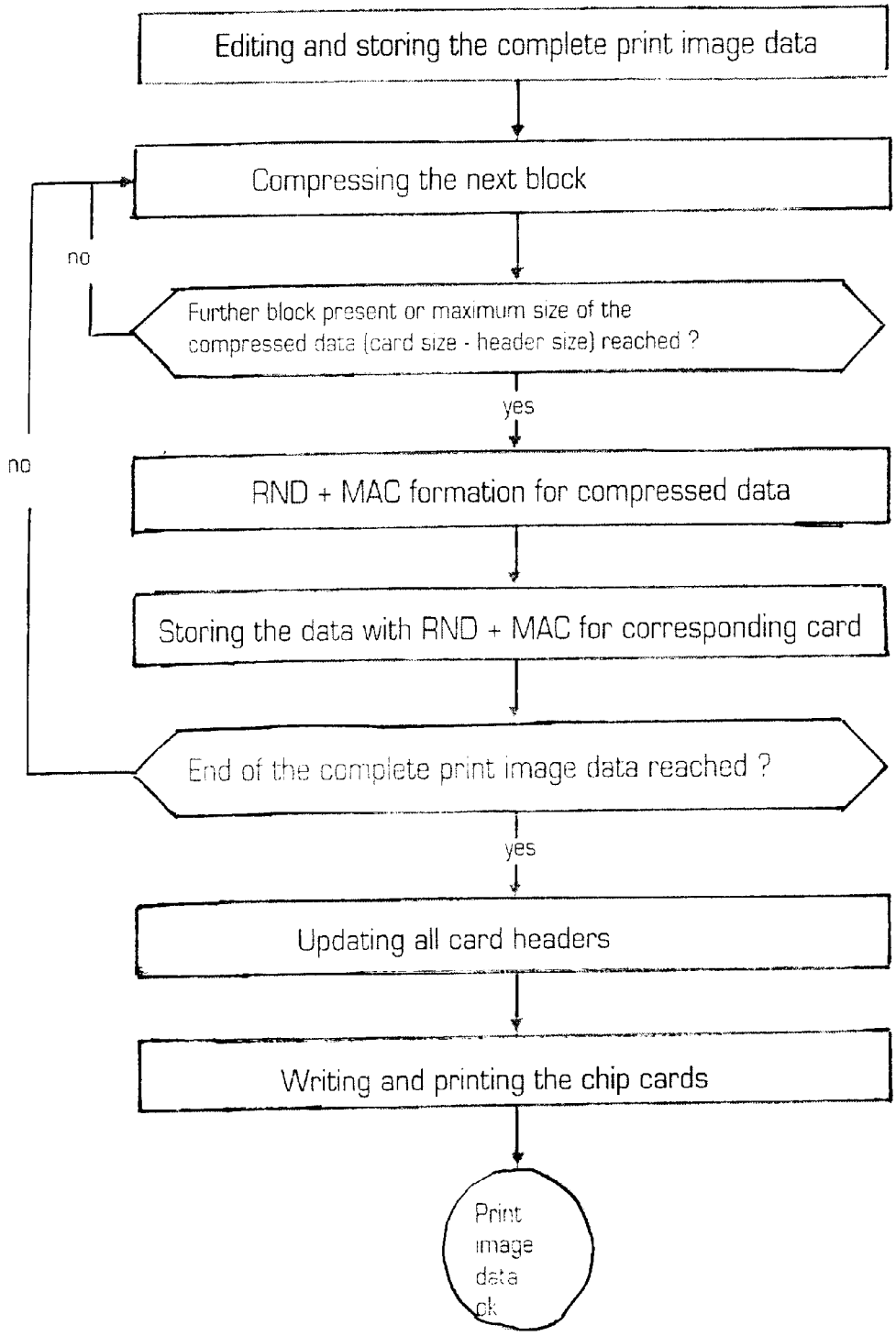
FIG. 4 is a flowchart for generating chip cards with complete print image data for producing an inventive image.
Figure 5:
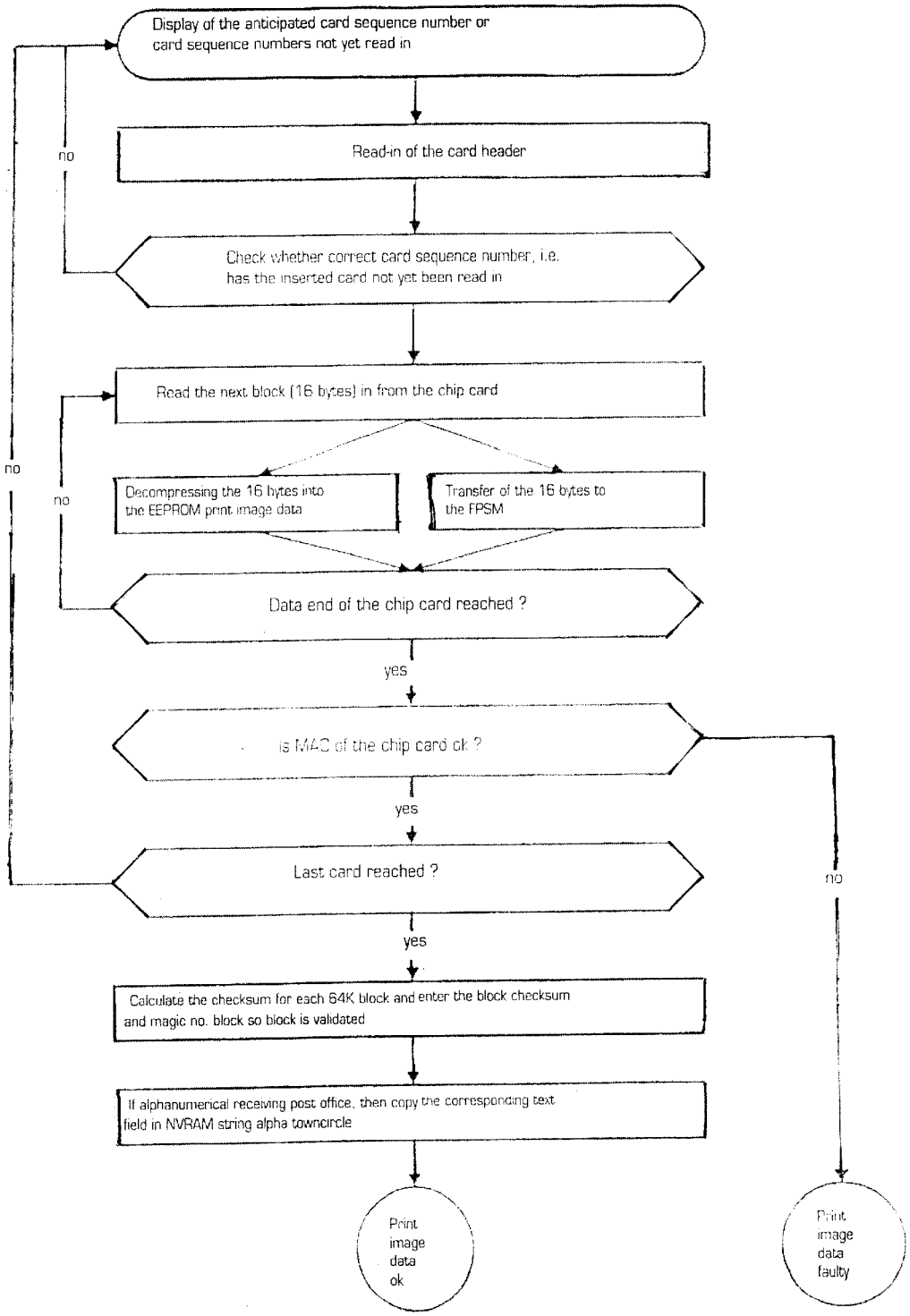
FIG. 5 is a flowchart for loading complete print image data, including data for producing an inventive image.
Figure 6:
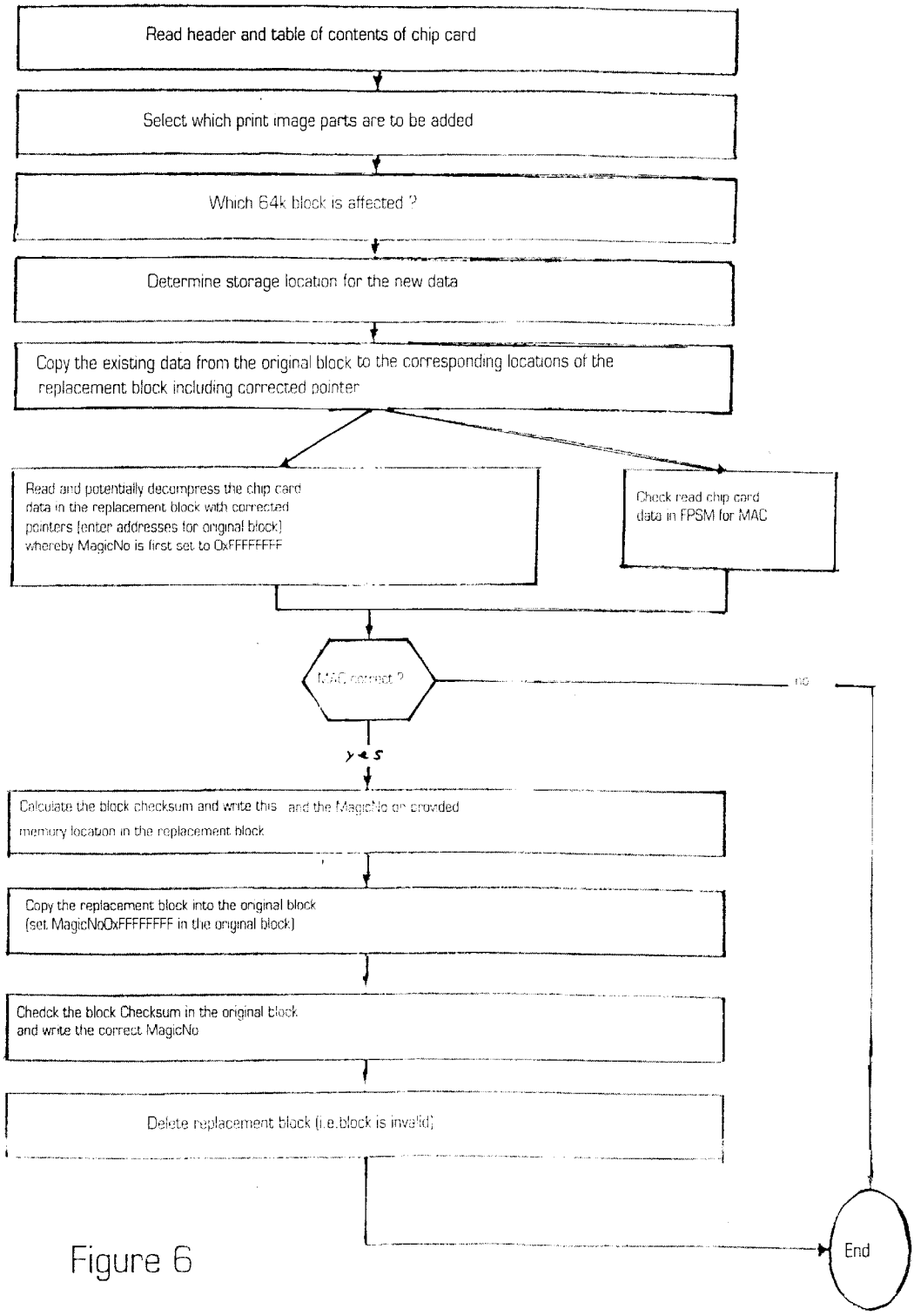
FIG. 6 is a flowchart for reloading chip cards with print image parts, including image parts for producing an inventive image.

FIG. 4 shows the flowchart for producing chip cards with complete print image data. FIG. 5 shows a flowchart for loading the overall print image data. FIG. 6 shows the flowchart for the reloading of print image parts (image elements) or the replacement of print image segments.

Figure 7:
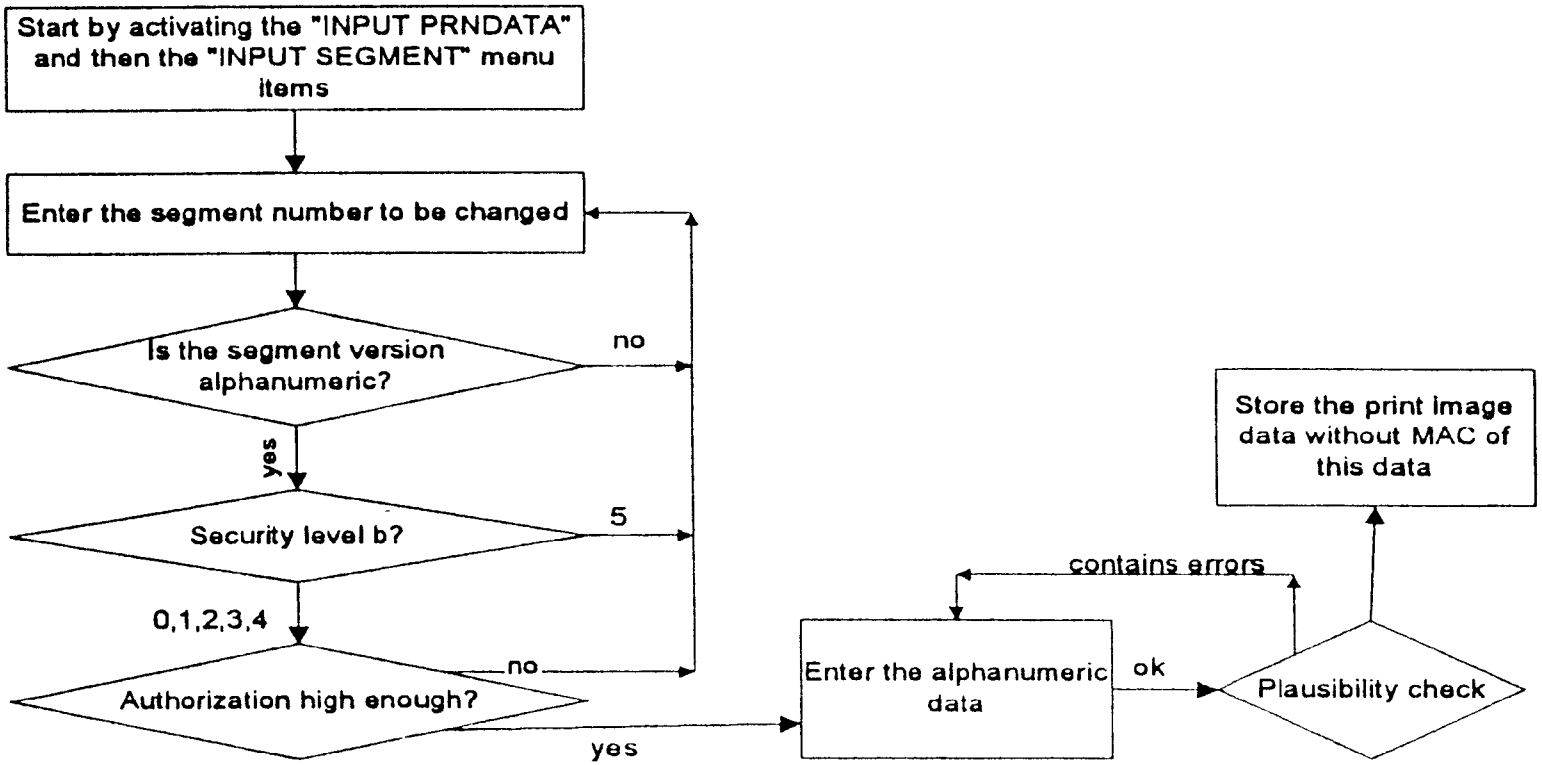
FIG. 7 is a flowchart for modifying print image data including for producing an inventive image.
Figure 8:
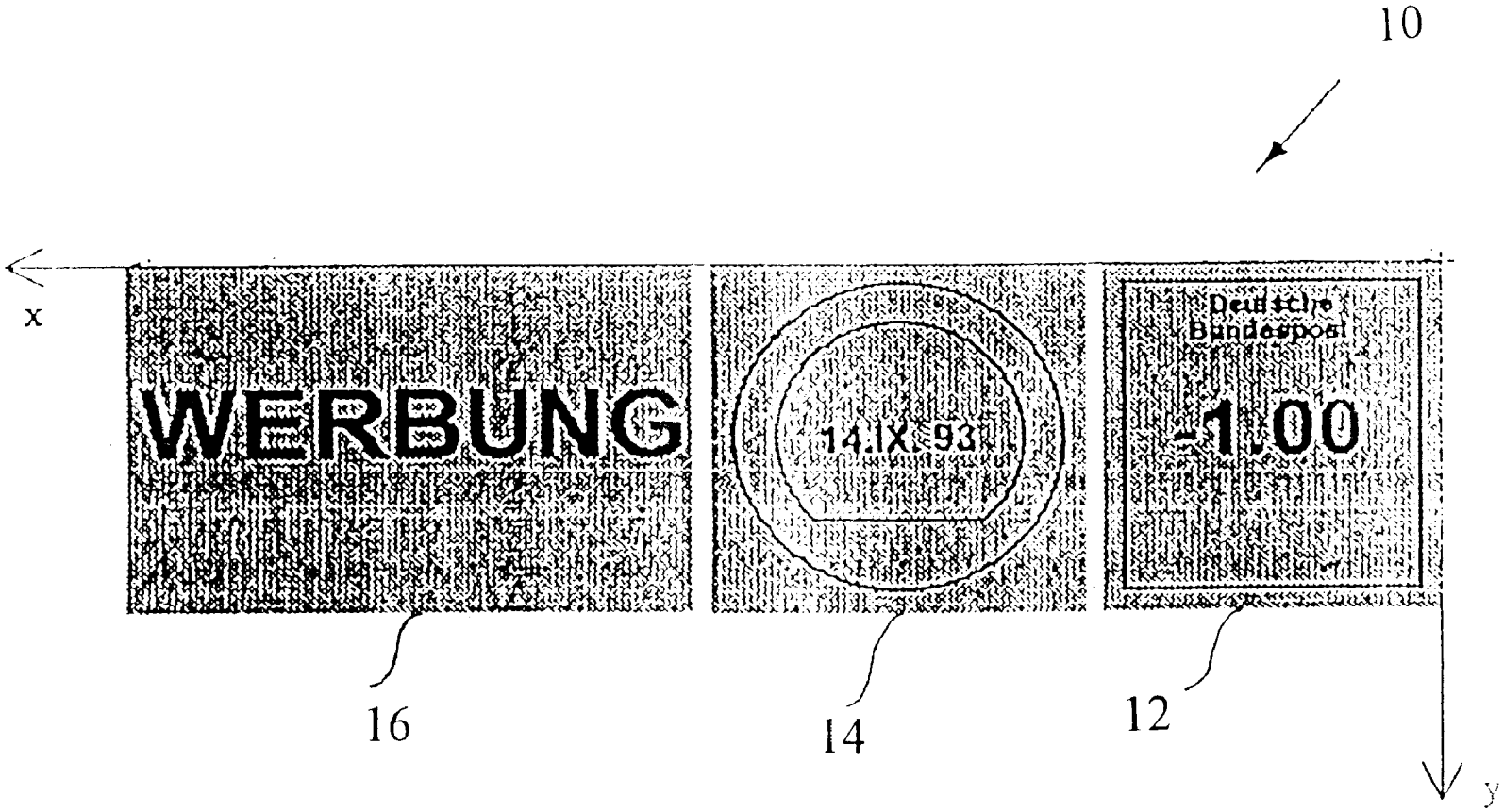
FIG. 8 is a print image composed of a postage stamp image, postmark image and an advertizing image according to the prior art.

FIG. 7 shows the flowchart for the modification of print image data in the postage meter machine. In addition to the query of the respective segment numbers, the security level is thereby also checked, and a check is also carried out to see whether the authorization by the respective card (user card, master card, dealer card, etc.) is high enough. When this is the case, the print image data can be stored in the postage meter machine.

Although modifications and changes may be suggested by those skilled in the art, it is the intention of the inventor to embody within the patent warranted hereon all changes and modifications as reasonably and properly come within the scope of his contribution to the art.

I claim as my invention:

1. A franking apparatus for printing a print image comprising:

a memory containing information regarding image elements of a print image, said information being selected from the group consisting of information regarding an appearance of the image element and information regarding a position of the image element within said print image, and containing security level data respectively assigned to said image elements;

a printer connected to said memory for printing said print image with said image elements with different security levels, in a hierarchical structure assigned to said image elements in said print image;

an input unit;

a control unit connected to said input unit and to said memory, said control unit allowing at least one of modification and deletion of said image data when said input unit is supplied with an authorization input having a security level associated therewith which is at least as high in said hierarchical structure as the security level of the image data to be modified or deleted; and said input unit including a first storage medium and a second storage medium connectable to said control unit, and wherein said first storage medium containing data representing said hierarchic security levels and said second storage medium containing said information regarding said print elements.

2. A franking apparatus as claimed in claim 1 wherein said memory in said franking device is couplable via said control unit to said first storage medium and to said second storage medium.

3. A franking apparatus as claimed in claim 1 wherein said control unit further requires entry of an authorization of a person, via said input unit, making said one of said modification and deletion of said image data said authorization of said person corresponding to one of said security levels in said hierarchical structure, and said control unit permitting image data to be modified or deleted having a security level which is at or below the security level associated with the person.

* * * * *